US005893469A

United States Patent [19]

Nozawa

[11] Patent Number: 5,893,469

[45] Date of Patent: Apr. 13, 1999

[54] SUPPORTING RACK ASSEMBLY FOR A WASHBASIN

[75] Inventor: Kumiko Nozawa, Kashiwa, Japan

[73] Assignee: Taiwan Nikko Co. Ltd., Taichung, Taiwan

[21] Appl. No.: 08/979,088

[22] Filed: Nov. 26, 1997

[51] Int. Cl.[6] ..... A47F 5/00

[52] U.S. Cl. ..... 211/71.01; 248/129; 248/165; 211/189; 211/126.1

[58] Field of Search ..... 211/71.01, 189, 211/126.1, 132.1, 133.1, 88.01, 85.18, 85.21, 85.23, 186; 248/163.1, 165, 129, 127, 128, 150

[56] References Cited

U.S. PATENT DOCUMENTS

| | | | |
|---|---|---|---|
| 1,628,722 | 5/1927 | Haertel | 248/129 |
| 2,591,467 | 4/1952 | Rodejer | 211/88.01 |
| 2,662,382 | 12/1953 | Potchen | 211/126.1 X |
| 3,176,848 | 4/1965 | Stefan | 211/189 X |
| 3,214,120 | 10/1965 | McKee | 248/129 |
| 3,479,047 | 11/1969 | Bailey | 248/129 X |
| 5,354,023 | 10/1994 | Meeks | 248/129 |

FOREIGN PATENT DOCUMENTS

| | | | |
|---|---|---|---|
| 356573 | 10/1961 | Switzerland | 211/90 X |

*Primary Examiner*—Robert W. Gibson, Jr.

*Attorney, Agent, or Firm*—Kolisch Hartwell Dickenson McCormack Heuser

[57] ABSTRACT

A rack assembly includes two stands each including two upright legs and a supporting section disposed there between. Two connecting rods are each mounted between the two upright legs of a corresponding one of the two stands. At least one supporting rack is mounted between the two connecting rods and includes two side bars each located adjacent to a corresponding one of the two connecting rods and each formed with at least one hook portion defining a recess for receiving an associated connecting rod. At least one retaining ring is fixedly mounted between the supporting section of the two stands.

7 Claims, 5 Drawing Sheets

SUPPORTING RACK ASSEMBLY FOR A WASHBASIN

FIELD OF THE INVENTION

The present invention relates to a rack assembly, and more particularly to a supporting rack assembly for a washbasin.

BACKGROUND OF THE INVENTION

A conventional supporting rack for a washbasin is shown in FIG. 6, and a complete illustration will follow in the detailed description of the preferred embodiments.

The present invention has arisen to mitigate and/or obviate the disadvantage of the conventional supporting rack.

SUMMARY OF THE INVENTION

In accordance with one aspect of the present invention, there is provided a rack assembly including two stands each shaped as an inverted 'u' two connecting rods each mounted between the two vertical legs of a corresponding one of the two stands, at least one supporting rack mounted between the two connecting rods and including two side bars each located adjacent to a corresponding one of the two connecting rods and each formed with at least one hook portion defining a recess for receiving an associated connecting rods, and at least one retaining ring fixedly mounted between the supporting section of the two stands.

Further features of the present invention will become apparent from a careful reading of the detailed description with appropriate reference to the accompanying drawings.

DETAILED DESCRIPTION OF THE PREFERRED EMBODIMENTS

Figure 6:
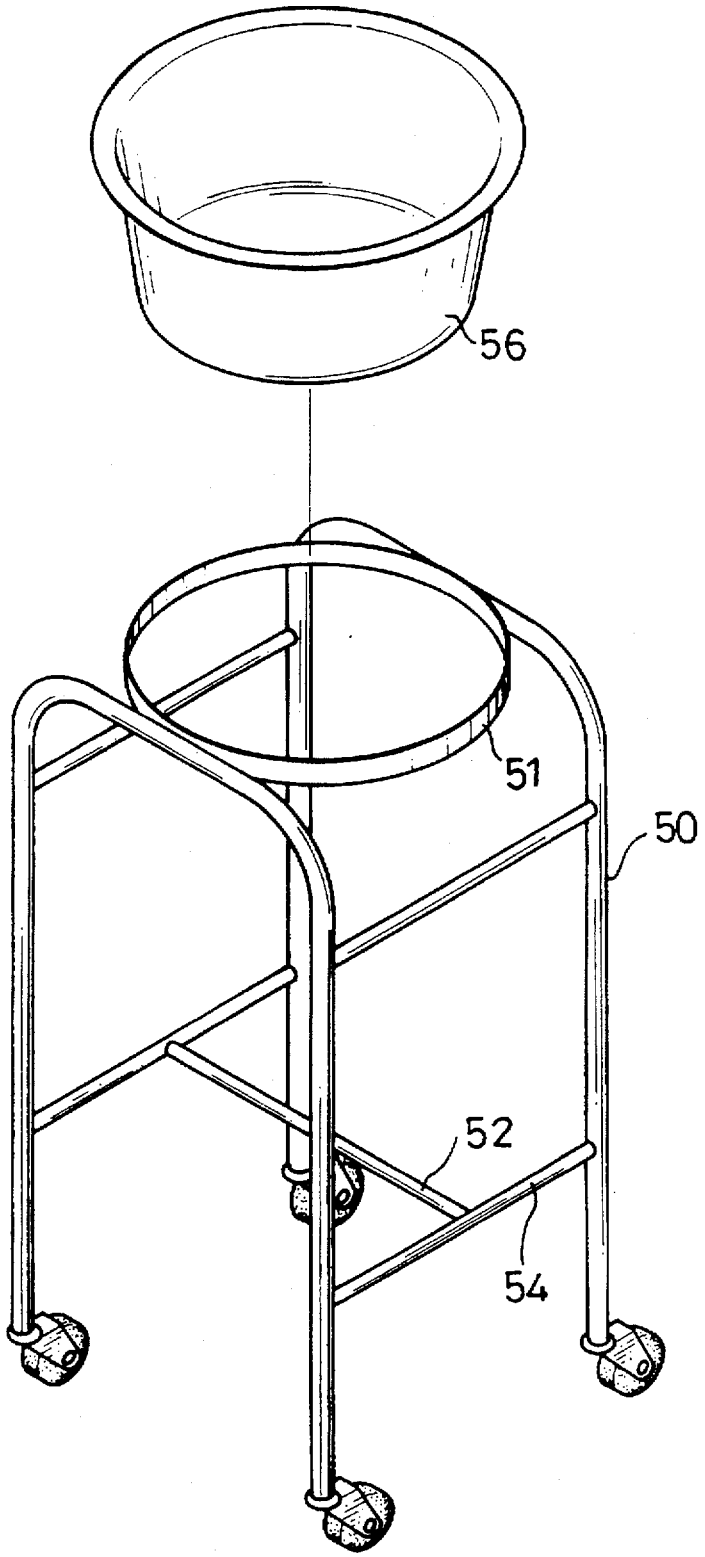
FIG. 6 PRIOR ART
FIG. 6 is a perspective view of a conventional supporting rack in accordance with the prior art.

For a better understanding of features and benefits of the present invention, reference is now made to FIG. 6, illustrating a conventional supporting rack for a washbasin 56 in accordance with the prior art.

The conventional supporting rack comprises two stands 50, two connecting rods 54 each mounted between the two stands 50 which are shaped as an inverted 'u', a linking rod 52 mounted between the two connecting rods 54, and a retaining ring 51 mounted between the two stands 50 for supporting the washbasin 56.

By such an arrangement, however, the supporting rack has a fixed structure and occupies a large space, thereby causing an inconvenience during transportation.

Referring now to FIGS. 1–4, a supporting rack assembly according to a first embodiment of the present invention can be adapted for supporting an object such as a washbasin 40 and includes two stands 10 each shaped as an inverted 'u' and comprising two upright legs 16 with an integral supporting section perpendicularly extending therebetween.

Two connecting rods 12 are each fixedly mounted between the two upright legs 16 of a corresponding one of the two stands 10. A suspension rod 11 is fixedly mounted between the two upright legs 16 of one of the two stands 10 and is located above the connecting rod 12. An object such as a towel may be hung on the suspension rod 11.

A supporting rack 20 is mounted between the two stands 10 and includes two side bars 21 each located adjacent to a corresponding one of the two connecting rods 12 and each formed with two resilient hook portions 22 each defining a recess 220 for receiving an associated connecting rod 12 therein.

Figure 1:
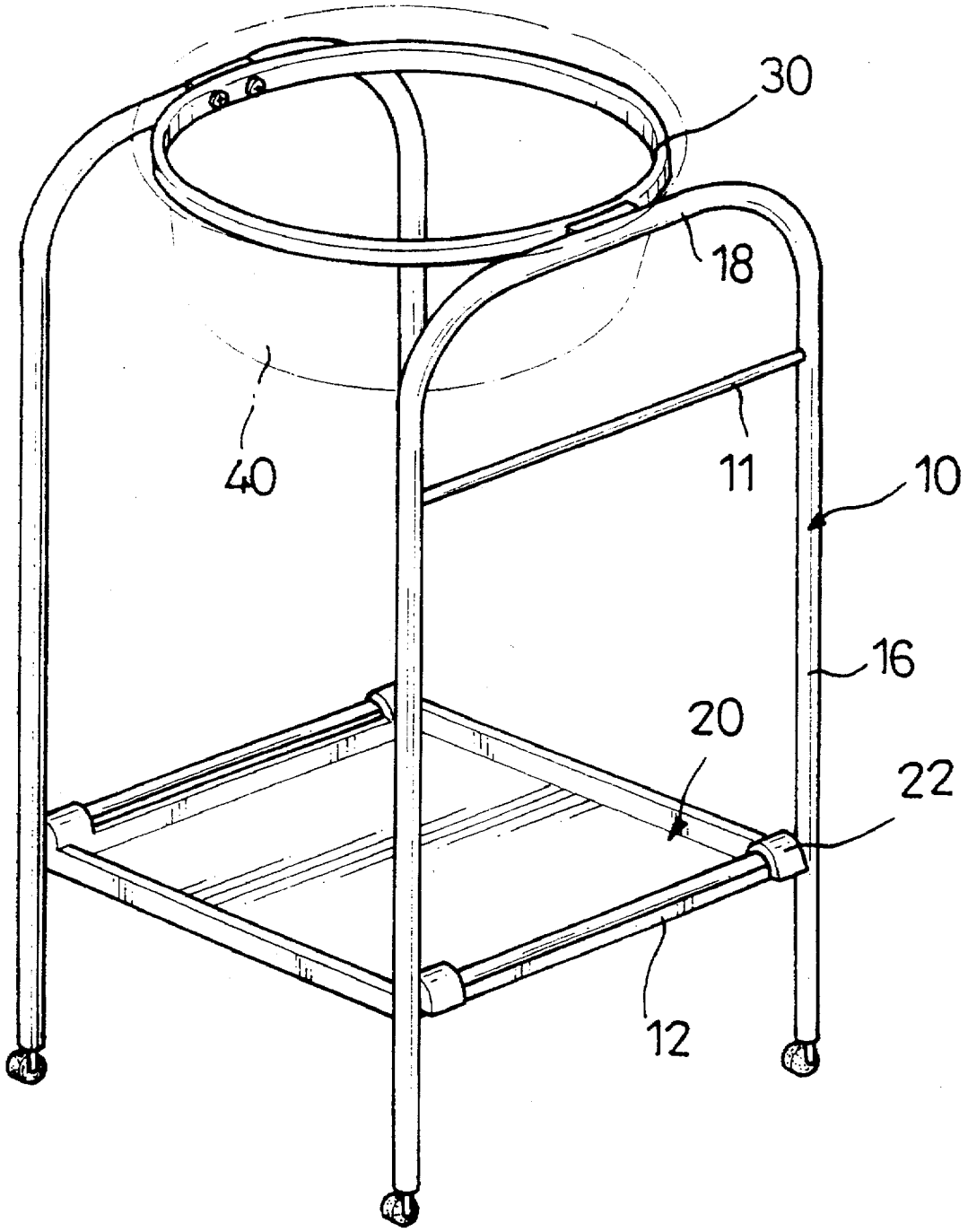
FIG. 1 is a perspective view of a supporting rack assembly according to a first embodiment of the present invention.
Figure 2:
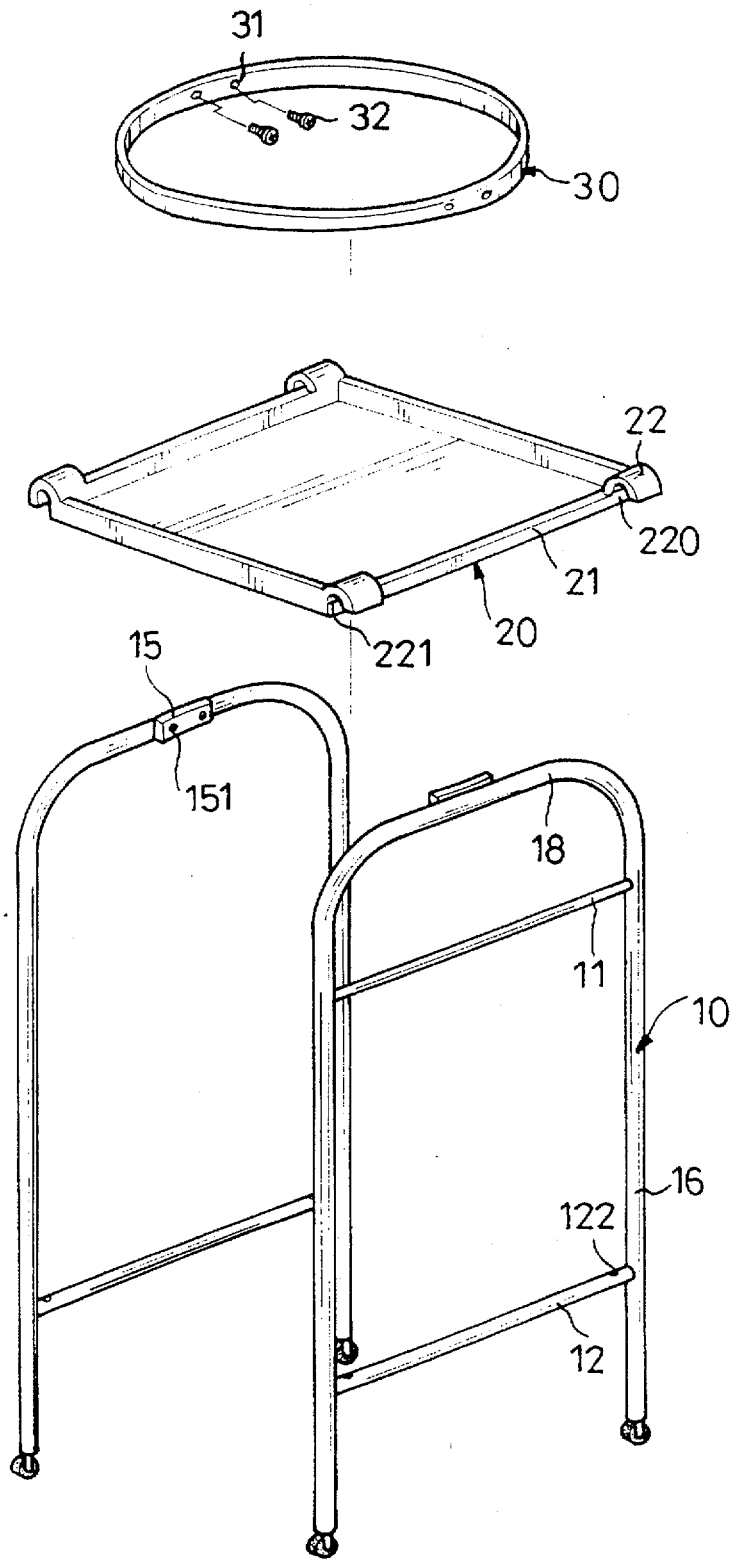
FIG. 2 is an exploded view of the supporting rack assembly shown in FIG. 1.
Figure 4:
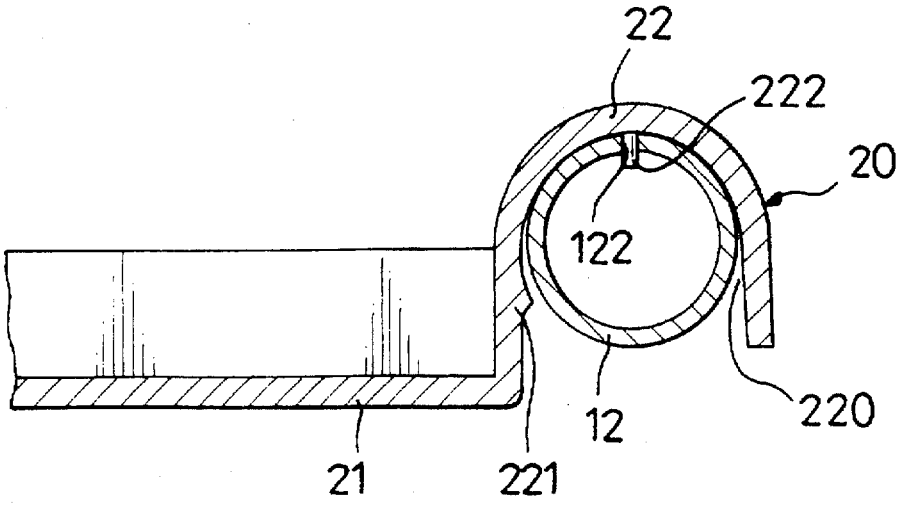
FIG. 4 is a partially cut-away front plan cross-sectional view of a portion of FIG. 1.

Referring to FIGS. 2 and 4, each of the hook portions 22 includes an inner wall formed with a stop 221 for retaining the connecting rod 12 such that each of the hook portions 22 is not easily detached from the connecting rod 12, and formed with a stub 222 extending inwardly and fitted in a hole 122 defined in the connecting rod 12 such that each of the hook portions 22 cannot slide on the connecting rod 12.

Figure 3:
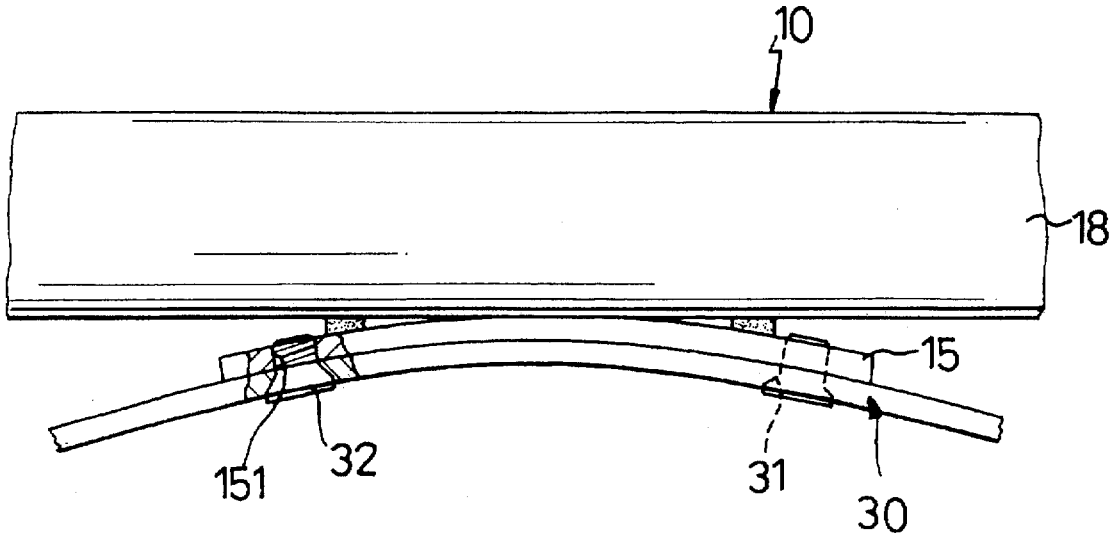
FIG. 3 is a partially cut-away top plan cross-sectional view of a portion of FIG. 1.

Referring now to FIGS. 2 and 3, a retaining ring 30 is fixedly mounted between the supporting sections 18 of the two stands 10 and includes two diametrically opposite arcuate portions each defining two bores 31.

Two arcuate fastener members 15 are each fixedly mounted on the supporting section 18 of a corresponding one of the two stands 10 and each define two threaded holes 151 each aligning with the bore 31 of a corresponding one of the two arcuate portions of the retaining ring 30.

Two pairs of positioning screws 32 each extend through an associated bore 31 of the retaining ring 30 and are each engaged in the threaded hole 151 of a corresponding one of the two fastener members 15 such that the retaining ring 30 can be securely mounted between each of the two fastener members 15.

Figure 5:
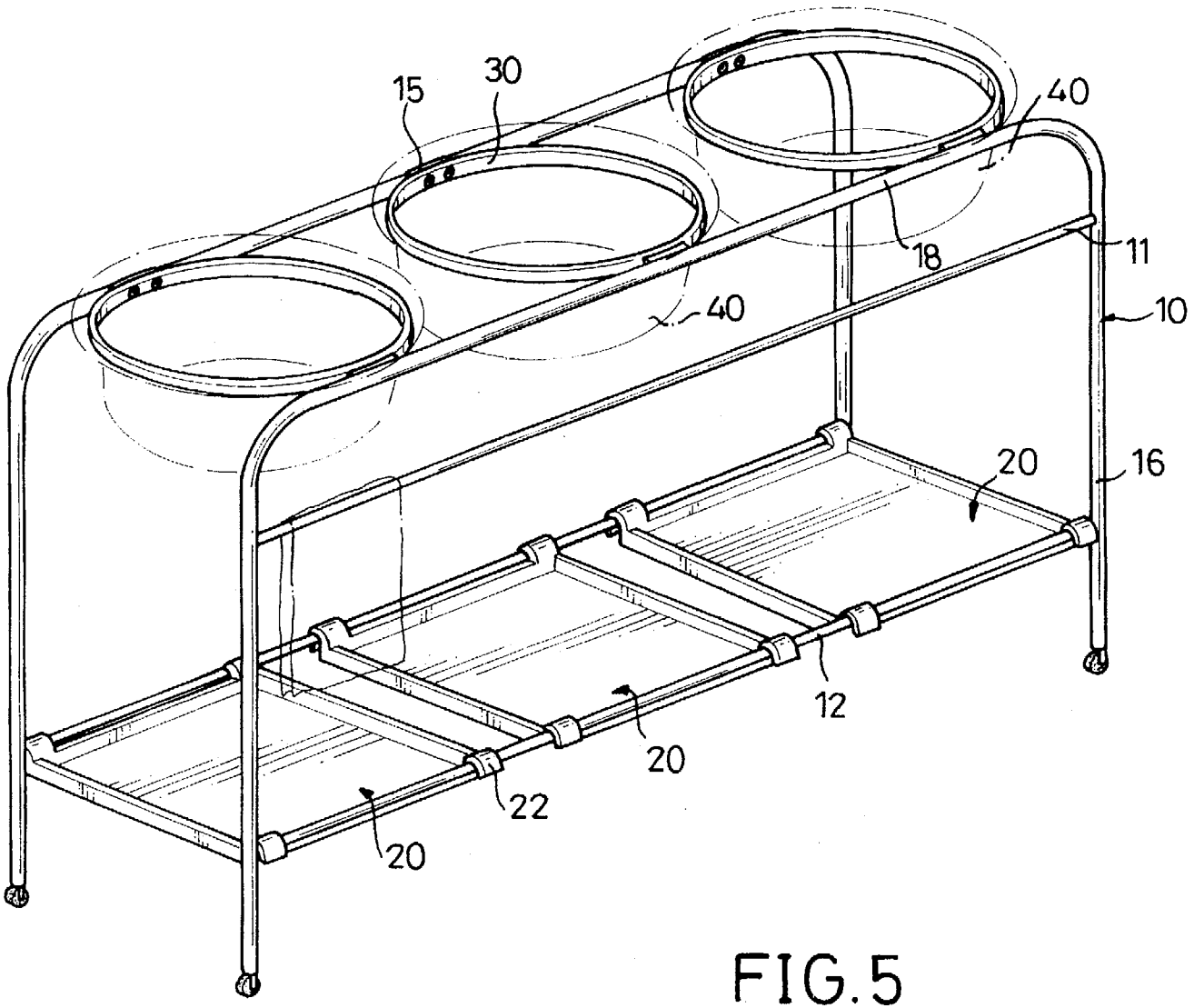
FIG. 5 is a perspective view of a supporting rack assembly according to a second embodiment of the present invention.

Referring to FIG. 5, according to a second embodiment of the present invention, a plurality of the supporting racks 20 are each mounted between the two connecting rods 12 and a plurality of the retaining rings 30 are each fixedly mounted between the supporting sections 18 of the two stands 10.

It should be clear to those skilled in the art that further embodiments of the present invention may be made without departing from the spirit and scope of the present invention.

What is claimed is:

1. A rack assembly comprising:

two stands each shaped as an inverted 'u' and including two upright legs and a supporting section extending between said two upright legs;

two connecting rods each mounted between said two uprights legs of a corresponding one of said two stands;

at least one supporting rack mounted between said two connecting rods and including two side bars, each side bar located adjacent a corresponding one of said two connecting rods and each side bar formed with at least one hook portion defining a recess for receiving an associated said connecting rod; and at least one retaining ring fixedly mounted between said supporting sections of said two stands.

2. The rack assembly according to claim 1, wherein said hook portion is resilient and includes an inner wall formed with a stop for retaining said connecting rod.

3. The rack assembly according to claim 1, wherein said at least one hook portion of each of said two side bars of said supporting rack includes an inner wall formed with a stub extending inwardly, and each of said two connecting rods defines at least one hole for receiving said hook portion of a corresponding one of said two side bars of said supporting rack.

4. The rack assembly according to claim 1, further comprising a suspension rod fixedly mounted between said two upright legs of one of said two stands and located above said connecting rod.

5. The rack assembly according to claim 1, wherein said retaining ring includes two diametrically opposite arcuate portions each defining at least one bore, and said rack assembly further comprises two fastener members each fixedly mounted on said supporting section of a corresponding one of said two stands and each defining at least one threaded hole aligning with said bore of a corresponding one of said two arcuate portions of said retaining ring, and at least two positioning screws each extending through an associated said bore of said retaining ring and each engaged in said threaded hole of a corresponding one of said two fastener members.

6. The rack assembly according to claim 1, wherein a plurality of supporting racks are each mounted between said two connecting rods.

7. The rack assembly according to claim 1, wherein a plurality of retaining rings are each fixedly mounted between said supporting section of said two stands.

* * * * *